US006601265B1

(12) United States Patent
Burlington

(10) Patent No.: US 6,601,265 B1
(45) Date of Patent: Aug. 5, 2003

(54) VACUUM CLEANER

(75) Inventor: Geoffrey Michael Burlington, Edge (GB)

(73) Assignee: Dyson Limited, Wiltshire (GB)

( * ) Notice: Subject to any disclaimer, the term of this patent is extended or adjusted under 35 U.S.C. 154(b) by 0 days.

(21) Appl. No.: 09/868,484

(22) PCT Filed: Dec. 6, 1999

(86) PCT No.: PCT/GB99/04077

§ 371 (c)(1),
(2), (4) Date: Jun. 18, 2001

(87) PCT Pub. No.: WO00/36961

PCT Pub. Date: Jun. 29, 2000

(30) Foreign Application Priority Data

Dec. 18, 1998 (GB) ..... 9827769

(51) Int. Cl.[7] ..... A47L 9/02
(52) U.S. Cl. ..... 15/319; 15/340.1
(58) Field of Search ..... 15/319, 340.1, 15/415.1, 340.3

(56) References Cited

U.S. PATENT DOCUMENTS

| | | | | |
|---|---|---|---|---|
| 4,306,329 A | * | 12/1981 | Yokoi | 15/319 |
| 4,517,705 A | | 5/1985 | Hug | |
| 5,032,775 A | | 7/1991 | Mizuno et al. | |
| 5,109,566 A | * | 5/1992 | Kobayashi et al. | 15/319 |
| 5,199,996 A | | 4/1993 | Jonas et al. | |
| 5,293,955 A | | 3/1994 | Lee | |
| 5,309,592 A | | 5/1994 | Hiratsuka | |
| 5,534,762 A | * | 7/1996 | Kim | 134/188 |
| 5,682,640 A | * | 11/1997 | Han | 15/319 |
| 5,720,077 A | | 2/1998 | Nakamura et al. | |
| 5,815,880 A | * | 10/1998 | Nakanishi | 15/319 |
| 5,903,124 A | | 5/1999 | Kawakami | |
| 5,940,927 A | * | 8/1999 | Haegermarck et al. | 15/319 |
| 6,119,057 A | * | 9/2000 | Kawagoe | 15/319 |

FOREIGN PATENT DOCUMENTS

| | | |
|---|---|---|
| EP | 0 562 559 A | 9/1993 |
| EP | 0 803 224 A | 10/1997 |
| GB | 0 958 803 | 5/1964 |
| GB | 2 225 221 A | 5/1990 |
| GB | 2 324 958 A | 11/1998 |
| JP | 10-105236 | 4/1998 |
| WO | WO 94/00046 | 1/1994 |
| WO | WO 97/37579 | 10/1997 |
| WO | WO 97/40734 | 11/1997 |
| WO | WO 97/41451 | 11/1997 |

* cited by examiner

*Primary Examiner*—Terrence R. Till
(74) *Attorney, Agent, or Firm*—Morrison & Foerster LLP

(57) ABSTRACT

The invention provides a vacuum cleaner (10) having a chassis (12), supporting wheels (14) mounted on the chassis (12), drive means (15) connected to the supporting wheels (14) for driving the supporting wheels (14) and a control mechanism for controlling the drive means (15) so as to guide the vacuum cleaner (10) across a surface to be cleaned. A cleaner head (22) having a dirty air inlet (24) facing the surface to be cleaned is mounted on the chassis (12) and separating apparatus (52) is supported by the chassis (12) and communicates with the cleaner head (22) for separating dirt and dust from an airflow entering the vacuum cleaner (10) by way of the dirty air inlet (24). The separating apparatus (52) comprises at least one cyclone(54, 56). This type of separating apparatus is not prone to clogging and therefore the pick-up capability of the cleaner (10) is maintained at a high standard.

22 Claims, 5 Drawing Sheets

VACUUM CLEANER

This application claims priority to International Application No. PCT/GB99/04077 which was published on Jun. 29, 2000.

1. Field of the Invention

The invention relates to a vacuum cleaner particularly, but not exclusively, to an autonomous or robotic vacuum cleaner.

2. Background of the Invention

Various proposals have been made in respect of autonomous or robotic vacuum cleaners, which are driven automatically and do not require to be propelled by a user across a surface to be cleaned. Essentially, such a vacuum cleaner comprises a body or chassis supported on wheels which are driven by a self-contained power pack and guided by a control system which navigates the vacuum cleaner around a room so that the floor or floor covering can be cleaned. For this purpose, the cleaner will also incorporate a cleaner head having a suction opening communicating with a dirt or dust collection device so that dirt and dust can be sucked up from the surface to be cleaned, separated from the airflow and stored in a container for disposal. Devices of this nature are shown and described in WO 97/40734 and WO 97/41451.

One of the disadvantages associated with devices of this type is that, in order for the machine to be able to manoeuvre into and out of small spaces, the device preferably has an essentially circular shape when seen in plan view. This allows the device to rotate about its own vertical axis when it has entered a restricted area so that it can turn around and locate a way out. Since any protrusion beyond the circular shape of the body will restrict the manoeuvreability of the device, the suction opening of the cleaner head is inevitably spaced away from the lateral extremity of the cleaner. This means that, when the cleaner is vacuuming along a wall or other edge of the area to be cleaned, the brush housed within the cleaner head cannot get as close to the wall or edge as existing vacuum cleaners which are manoeuvred by a user.

It is an object of the present invention to provide a vacuum cleaner of the type described above which can operate in close proximity to a wall or other edge. It is another object of the present invention to provide a vacuum cleaner of the type described above which can operate in close proximity to a wall or other edge without restricting the manoeuvrability of the vacuum cleaner. It is a further object of the present invention to provide a vacuum cleaner of the type described above which is capable of manoeuvring past small obstacles without becoming lodged. It is a further object of the present invention to provide a vacuum cleaner of the type described above which is capable of cleaning a larger proportion of the surface to be cleaned than known vacuum cleaners of this type.

SUMMARY OF THE INVENTION

The invention provides a vacuum cleaner comprising a body having supporting wheels, drive means for driving the wheels so as to propel the vacuum cleaner in a direction across a surface to be cleaned, dust and dirt separating apparatus and a fan for drawing air into the dust and dirt separating apparatus, the vacuum cleaner also having a cleaner head mounted beneath the body, transversely to said direction, and incorporating a dirty air inlet facing the surface to be cleaned, characterised in that the cleaner head protrudes transversely beyond the body on at least one side of the vacuum cleaner.

Providing a cleaner head which protrudes transversely beyond the body on at least one side of the vacuum cleaner means that, at least on the side on which the cleaner head protrudes, the vacuum cleaner is able to clean closer to a wall or other obstacle than previously known vacuum cleaners of the type described above. This arrangement provides a higher standard of cleaning than known vacuum cleaners and increases the product satisfaction of consumers.

In a preferred embodiment, the cleaner head is movable transversely with respect to the body so as to reduce or eliminate the protrusion thereof beyond the body. This arrangement allows the cleaner head to be retracted beneath the body of the vacuum cleaner so that, if the vacuum cleaner is required to manoeuvre within a confined area, the protruding cleaner head does not restrict the manoeuvreability of the vacuum cleaner. The transverse moveability of the cleaner head also allows the cleaner head to retract when small obstacles are located within the path of the cleaner head and this avoids the need to divert the whole vacuum cleaner from its previous direction of travel.

This arrangement is particularly advantageous for cleaners which have a body that is substantially circular in plan view. However, it can also be used on cleaners having bodies which are not circular.

BRIEF DESCRIPTION OF THE DRAWINGS

Other preferred features are set out in the subsidiary claims. Further advantages of the features of the invention will become clear from the following description. A preferred embodiment of the invention will now be described by way of example only with reference to the accompanying drawings, wherein:

DETAILED DESCRIPTION OF THE INVENTION

Figure 1:
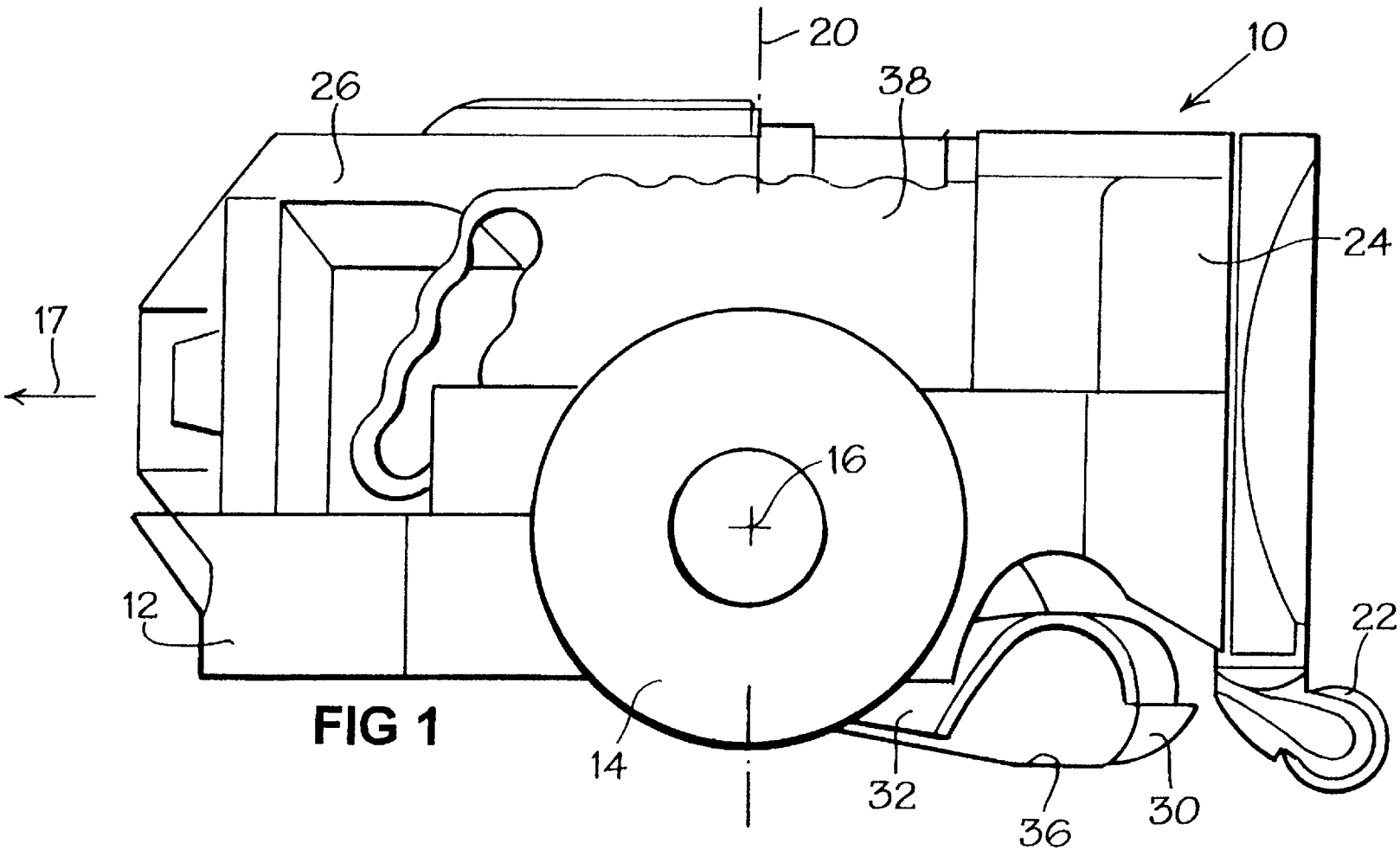
FIG. 1 is a side view of a first embodiment of an autonomous or robotic vacuum cleaner according to the invention.
Figure 2:
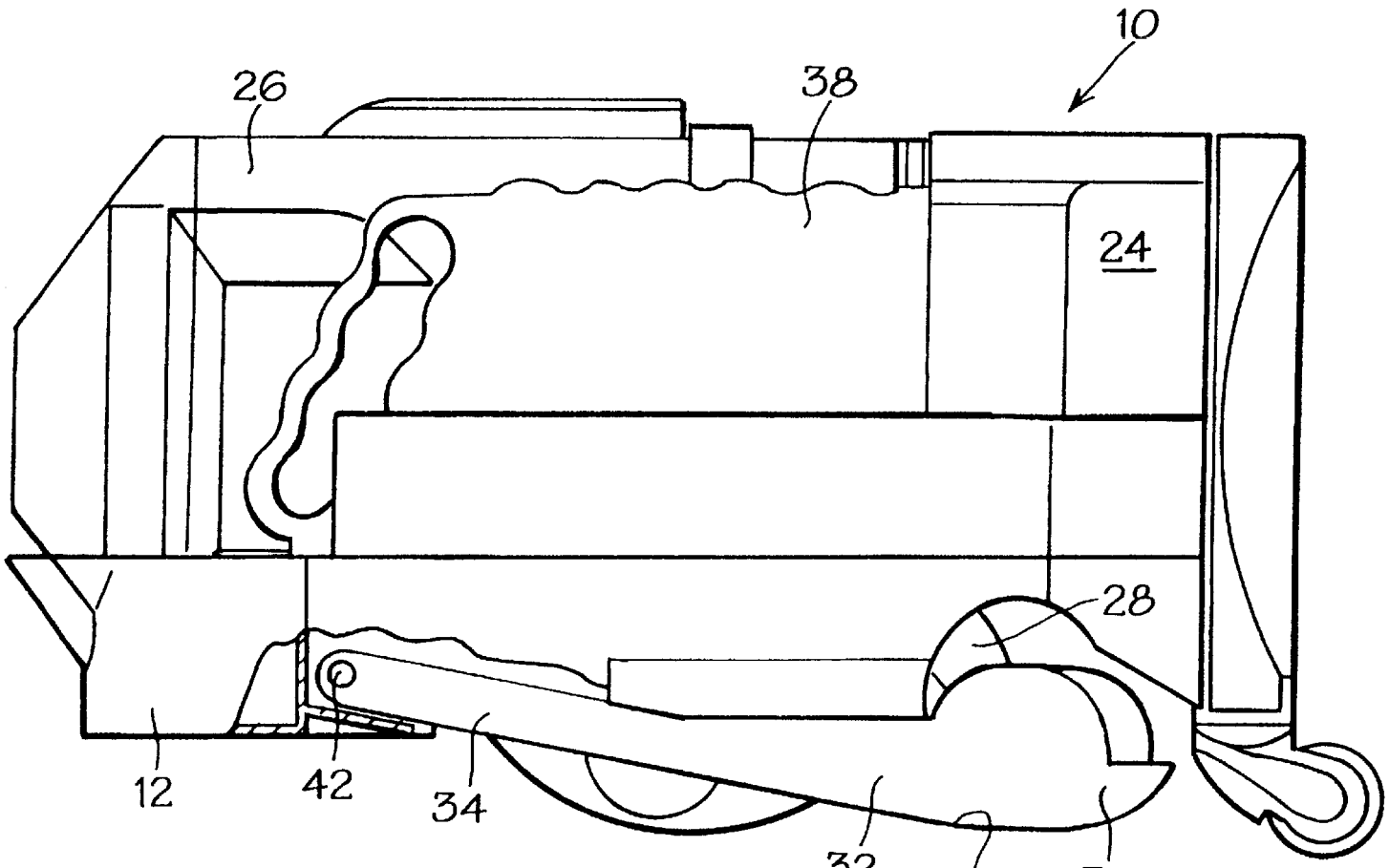
FIG. 2 is a side view of the cleaner of FIG. 1 with the driven wheel omitted for clarity.
Figure 3:
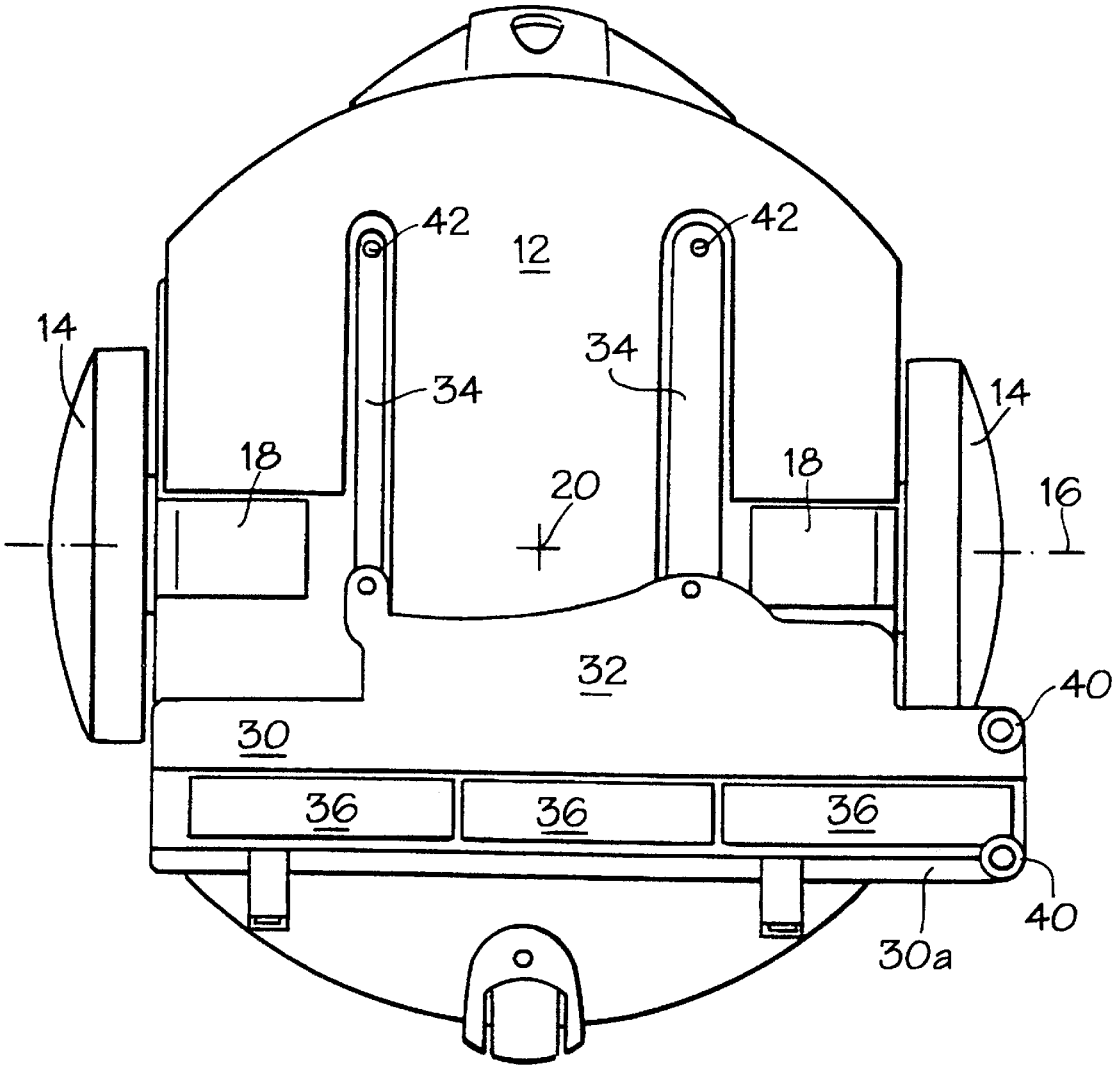
FIG. 3 is an underneath view of the cleaner of FIG. 1.

The vacuum cleaner 10 shown in FIGS. 1 to 3 of the accompanying drawings is designed to be autonomous or robotic. The vacuum cleaner 10 is thereby able to operate without any propulsion from a user. Essentially, it consists of a generally circular chassis 12 supported by two wheels 14 which are arranged diametrically opposite one another and rotatable about an axis 16 arranged perpendicular to the normal direction of motion of the vacuum cleaner 10 indicated by arrow 17. The chassis 12 carries separate motors 18 for driving each wheel 14, either in the same direction for forward motion or in opposite directions to allow the cleaner 10 to revolve about its own vertical axis 20. The motors can also be driven at different speeds in order to allow the cleaner 10 to turn corners. Sensors (not shown) are provided on the chassis 12 or on a housing of the vacuum cleaner (not shown) in order to allow the vacuum cleaner 10 to detect the proximity of walls, furniture and obstacles in its path. Control means operable in response to the output of the sensors operate the motors 18 to drive the wheels 14 over a surface to be cleaned whilst avoiding obstacles. However, the sensors and control means do not form part of the present invention and will not be described any further here. A trailing castor wheel 22 is provided centrally at the rear of the chassis 12 to provide additional support for the vacuum cleaner 10.

The vacuum cleaner 10 also supports a motor and fan unit 24 connected to dirt and dust separating apparatus 26 arranged on the chassis 12. In this embodiment, the dirt and dust separating apparatus 26 consist of a cyclonic separator comprising two cyclones arranged in series. The configuration of such separating apparatus is well known and will not be described any further here, save to say that the apparatus 26 is removably attached to the chassis 12 by means of resilient, quick-release fasteners to allow for emptying of the apparatus 26 when it becomes full. However, the nature of the dirt and dust separating apparatus 26 is not important to the present invention and the cyclonic separator can if desired be replaced by a conventional bag filter. The inlet to the dirt and dust separating apparatus 26 is connected via a flexible pipe 28 to a brush housing 30 forming part of a cleaner head 32. The cleaner head 32 is arranged beneath the rear part of the chassis 12 and the brush housing 30 is connected to the chassis 12 by means of two parallel elongate arms 34. The brush housing 30 incorporates a suction opening 36 which faces downward towards the surface to be cleaned. The cleaner head 32 is freely pivotable with respect to the chassis 12 so that, in use, the brush housing 30 floats on the surface to be cleaned and is maintained in contact therewith by virtue of its own mass. This enables the brush housing 30 to lift away from the surface to be cleaned in the event of a small obstacle being encountered during the cleaning operation without the entire weight of the cleaner 10 having to be lifted.

The chassis 12 also carries two power packs 38 in the from of rechargeable batteries. The batteries 38 are removably attached to the chassis 12 to allow the user to transport them to a recharging station between cleaning sessions. When the batteries 38 are charged and affixed to the chassis 12, connections provide for power to be supplied to the drive motors 18, to the sensors and control means which navigate the cleaner 10, and to the motor and fan unit 24 which draws dirty air into the dirt and dust separating apparatus 26 via the brush housing 30. This allows the cleaner 10 to navigate around a room or other defined area to vacuum the floor or floor covering without bumping into obstacles.

As can be seen from FIG. 3, the brush housing 30 is mounted so that one end thereof 30*a* protrudes beyond the chassis 12 and, indeed, beyond the outer extremity of the supporting wheel 14 on the side of the cleaner 10 on which the brush housing 30 protrudes. In this way, the brush housing 30 can approach a wall or obstacle alongside which the vacuum cleaner 10 is moving so that cleaning can take place very close to that wall or obstacle. This arrangement is highly advantageous in that the standard of cleaning coverage achieved by the vacuum cleaner 10 is very high. Because the end 30*a* of the brush housing 30 can often be required to travel along a wall or other fixed obstacle whilst in contact therewith, vertically mounted wheels or rollers 40 are provided at the distal end of the brush housing 30 to allow rolling contact with an obstacle in order that the risk of any damage thereto is minimised. The presence of the wheels or rollers 40 prevents the end 30*a* of the brush housing 30 from scraping along the wall and causing damage thereto.

The elongate members 34 by means of which the brush housing 30 is mounted on the chassis 12 are inclined at a small angle of inclination to the horizontal and extend generally parallel to the surface to be cleaned and to the lower surface of the chassis 12. The elongate members 34 are fixedly connected to or formed integrally with the brush housing 30 and connected to the chassis 12 by means of pivoting joints 42 which allow the elongate members 34 to pivot within a vertical plane about the joints 42 so that the brush housing 30 is able to move in a vertical direction with respect to the surface to be cleaned. Sufficient clearance is allowed between the underside of the chassis 12 and the brush housing 30 to allow vertical movement of the brush housing 30 with respect to the chassis and, within certain limits, this can be achieved by providing appropriate shaping in the underside of the chassis 12. The intention is to allow the brush housing 30 to travel or "float" over small obstacles, such as electric cables, rugs, books or papers lying on the surface to be cleaned, without the cleaner head 32 having to lift the entire mass of the vacuum cleaner 10. The advantage of such an arrangement is that the cleaner does not need to be deviated from its desired path more often than is necessary.

Figure 4:
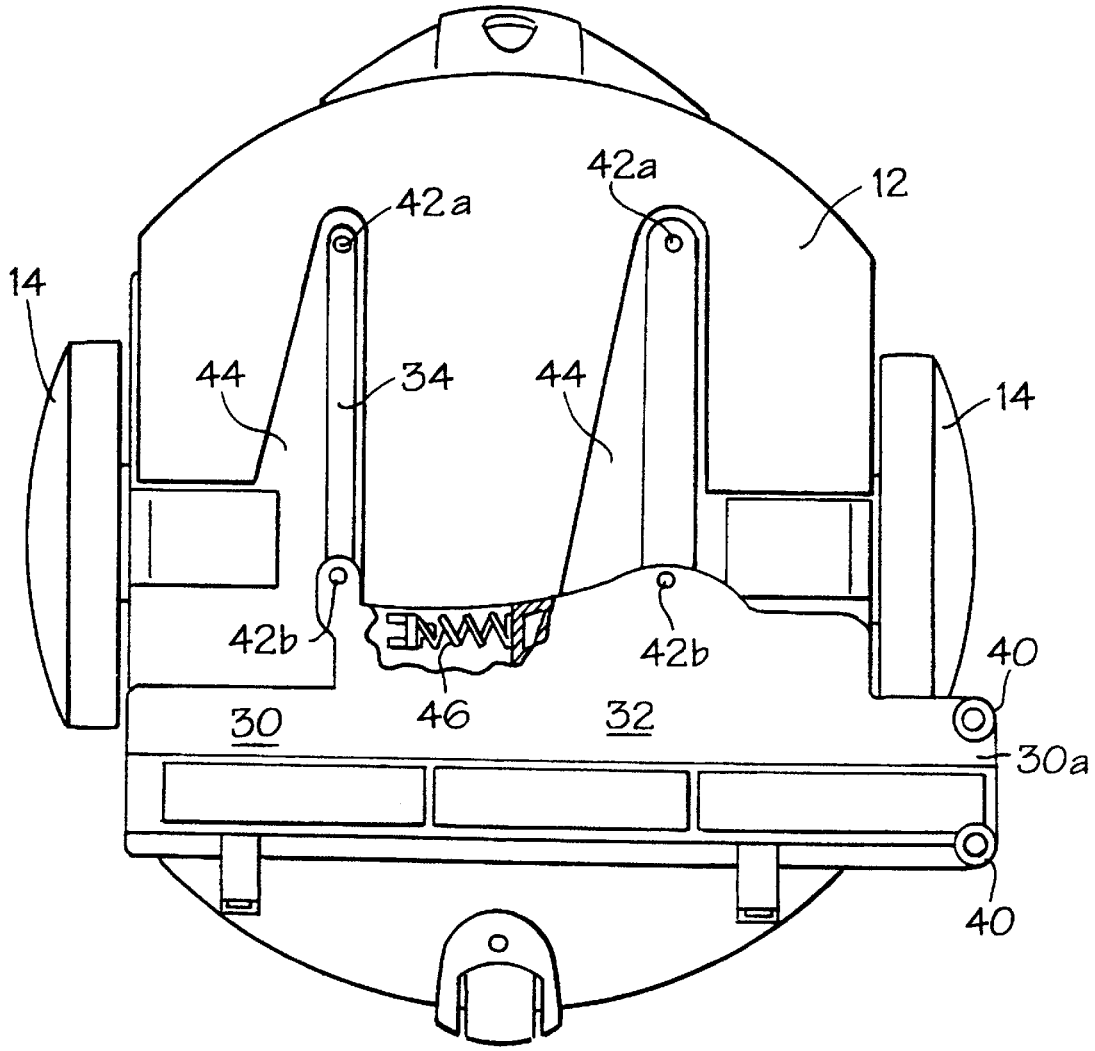
FIG. 4 is an underneath view of a first alternative embodiment according to the invention.

A second embodiment of a vacuum cleaner according to the invention is illustrated in FIG. 4. The Figure shows an underneath view of the cleaner, similar to FIG. 3. Corresponding components have been given reference numerals identical to those used in FIGS. 1 to 3. The only significant difference between the embodiments of FIGS. 1 to 3 and FIG. 4 is the arrangement by means of which the cleaner head 32 is mounted on the chassis 12. In this second embodiment, the cleaner head 32 is mounted so that, in addition to the vertical movement of the brush housing 30 allowed by pivotal movement of the elongate members 34 in a vertical plane about pivoting joints 42*a*, the cleaner head 32 is also able to move transversely with respect to the chassis 12. This is achieved by making use of universal or similar joints 42*a*, 42*b* at either end of each elongate member 34 to connect the elongate members 34 to the chassis and the brush housing respectively. Ball joints are suitable but any other joint or combination of joints which allows the elongate member 34 to pivot, within predetermined limits, within both a vertical plane and a horizontal plane will be adequate.

The ability of the brush housing 30 to move in a vertical plane has the same effect and advantage as that described above. However, the ability of the brush housing 30 to move in a direction transverse to the normal direction of travel of the vacuum cleaner 10 gives an added advantage of the second embodiment over the first. The transverse movement of the brush housing 30 allows the protruding brush housing 32 to "retract" in the event that an obstacle is encountered on which, if the transverse movement were not allowed, the brush housing 30 would become lodged, but which is sufficiently small that the main body of the vacuum cleaner would be allowed to pass if the brush housing 30 did not protrude. Should the brush housing 30 encounter such an obstacle, the brush housing 30 is merely pushed inwardly so that the protruding end 30*a* is retracted towards the main body of the vacuum cleaner 10. The cleaner 10 can then proceed along its original path without requiring the entire mass of the body to be deflected, which would require additional energy consumption.

The wheels or rollers 40 arranged on the protruding end 30*a* of the brush housing 30 assist greatly in allowing the brush housing 30 to move transversely in the event that an obstacle is encountered. The outermost portions of the wheels or rollers 40 come into direct contact with the obstacle and "roll around" the obstacle so that the brush housing 30 does not become lodged.

The underside of the chassis 12 is shaped so as to include recesses 44 which allow the elongate members 34 to pivot within certain limits about joints 42*a* within a horizontal plane. The recesses 44 can be used to prevent the brush housing 30 from moving beyond a specified limit by causing the elongate members 34 to abut against the sides of the recesses and thereby prevent further movement.

Biasing means in the form of a compression spring 46 are provided in order to bias the brush housing 30 into the position shown in FIG. 4. However, the biasing force is designed to be low enough not to present any significant hindrance to the transverse movement of the brush housing 30 when an obstacle is encountered. Under the influence of the biasing means 46, the brush housing 30 is normally maintained in its protruding position but can easily be retracted against the biasing force in the event that an obstacle is encountered. The biasing means can take any form suitable for biasing the brush housing into the position shown in FIG. 4: alternatives to the illustrated compression spring are elastomeric bands, foamed plastic blocks and other resilient components designed to bias the brush housing into the protruding position.

Figure 5:
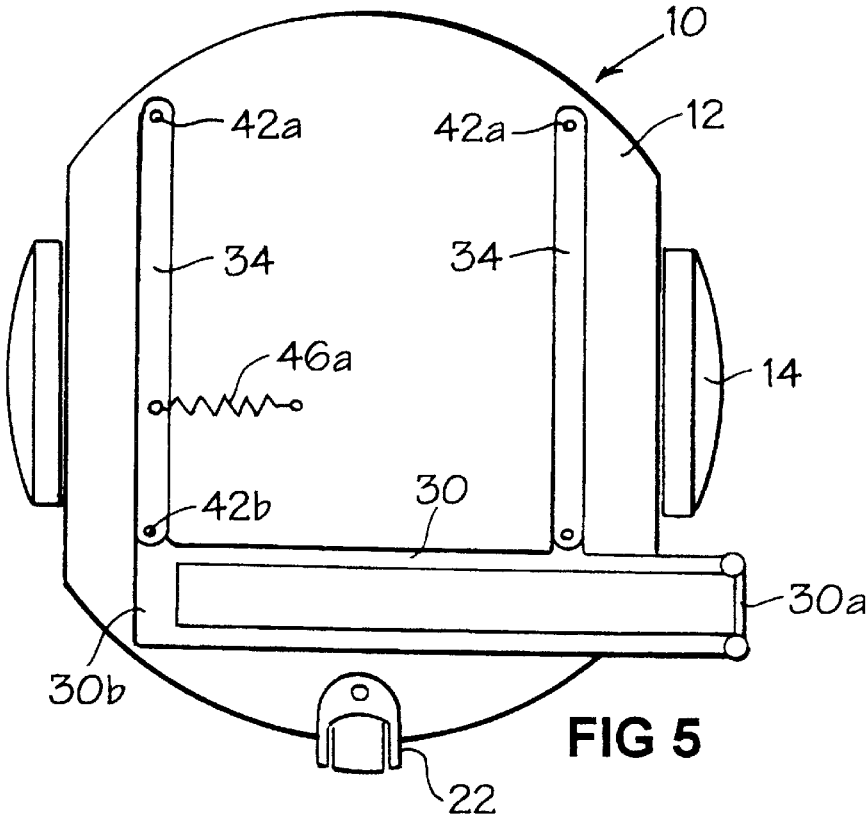
FIG. 5 is a schematic underneath view of a second alternative embodiment according to the invention.

The embodiment illustrated in bold lines in FIG. 4 has a brush housing 30 which extends, on the side opposite to the protruding end 30*a*, to the same extent as it would if the protruding end 30*a* did not protrude, i.e. as far as the general circular outline of the cleaner 10. However, in an alternative embodiment illustrated in FIG. 5, the non-protruding end 30*b* of the brush housing 30 is shortened so that, when the protruding end 30*a* is retracted back under the chassis 12, the non-protruding end 30*b* remains substantially within the circle defined by the chassis 12 and the rear castor 22. In the event that the vacuum cleaner 10 becomes trapped in a very restricted area and requires to turn about its own vertical axis in order to exit the confined area, the brush housing 30 can be retracted almost completely beneath the chassis 12 of the vacuum cleaner 10 so that it does not protrude to any significant extent. In this way, the vacuum cleaner's manoeuvreability is not compromised. The cleaner 10 illustrated in FIG. 5 utilises a tension spring 46*a* acting between one of the elongate members 34 and an appropriate portion of the chassis 12 as the biasing means.

Figure 6:
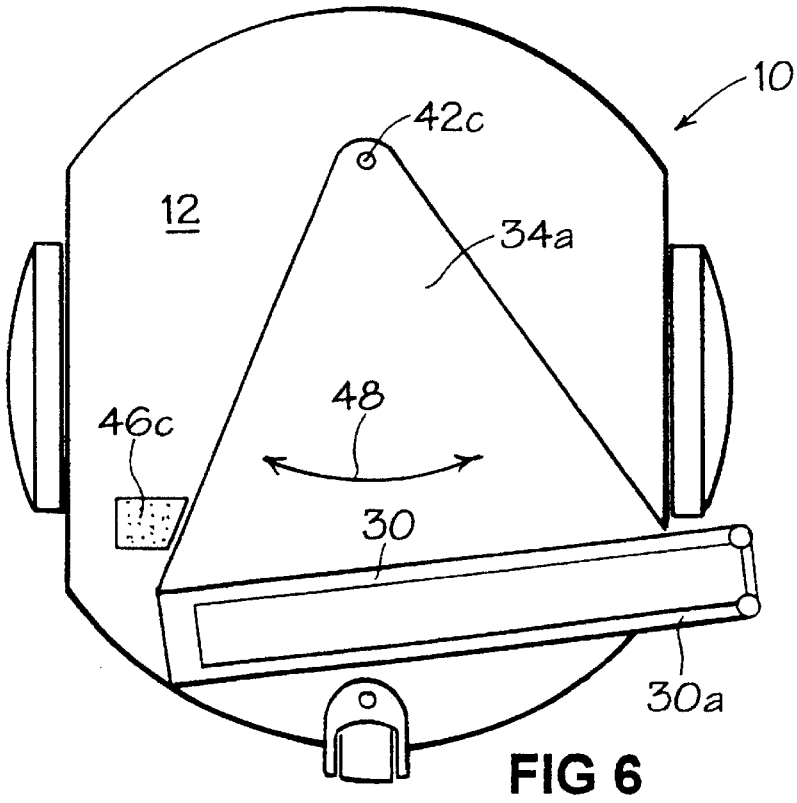
FIG. 6 is a schematic underneath view of a third alternative embodiment according to the invention.

In a further alternative embodiment of the invention, the brush housing 30 is mounted on a generally triangular plate 34*a* by way of a single universal or similar joint 42*c*. The joint 42*c* allows the brush housing 30 to move in a vertical plane to ride or float over small obstacles on the floor as described above and also to pivot about the joint 42*c* in a horizontal plane as illustrated by the arrow 48 in FIG. 6. The protruding end 30*a* of the brush housing 30 is able to move back under the chassis 12 in a swinging motion when a small obstacle is encountered by the end 30*a* of the brush housing 30. The swinging motion is opposed by a small block of resilient foamed plastic 46*c* which is affixed to the underside of the chassis 12. The block 46*c* biases the triangular plate 34*a* into the position shown in FIG. 6 in which the end 30*a* of the brush housing 30 protrudes beyond the lateral extremity of the vacuum cleaner 10.

In operation, the vacuum cleaner 10 is propelled under its own power supplied by the rechargeable batteries 38 across a surface to be cleaned. The drive motors 18 drive the wheels 14 across the surface guided by the control system and sensing equipment. In its normal mode of operation, the vacuum cleaner 10 will travel around the area to be cleaned in such a way that the protruding side of the brush housing 30 is always directed towards an obstacle around which the vacuum cleaner 10 is to navigate. For example, if the vacuum cleaner 10 is to circumnavigate a room keeping close to the walls, the vacuum cleaner 10 will locate itself so that the protruding end 30*a* of the brush housing 30 comes as close as possible to the said walls. If the vacuum cleaner 10 encounters a small obstacle protruding into the room, the brush housing 30 can retract automatically under the chassis 12 to allow the cleaner to continue moving in a substantially straight line whilst the object is passed. The retractability of the brush housing 30 also assists when the vacuum cleaner 10 is turning around corners because the extremity of the corner can be regarded as a small obstacle. The retractability of the brush housing 30 under the chassis 12 will ensure that the area around the corner will be cleaned to the maximum extent possible.

A rotating brush bar is mounted within the brush housing 30 so as to protrude slightly through the suction opening 36 in the normal way. The brush bar is driven by any suitable means, preferably by a separate motor carried by the cleaning head 32.

The invention is not limited to the specific features of the embodiment described above. If desired, the brush housing 30 of the cleaner head 32 can be arranged to protrude on both sides of the chassis 12 to allow close-to-the-edge cleaning on both sides of the cleaner 10. Such an arrangement would compromise the vacuum cleaner's manouevreability, but may be satisfactory in many applications. The cleaner head 32 could then be made to be moveable transversely in either direction in order to be able to accommodate obstacles located on either side of the vacuum cleaner. Other modifications and variations will be apparent to a skilled reader.

What is claimed is:

1. An autonomous vacuum cleaner, comprising a body having supporting wheels, drive means for driving the wheels so as to propel the vacuum cleaner in a direction across a surface to be cleaned, dust and dirt separating apparatus, a fan for drawing air into the dust and dirt separating apparatus and a cleaner head mounted beneath the body, transversely to said direction, and incorporating a dirty air inlet facing the surface to be cleaned, wherein the cleaner head protrudes transversely beyond the body on a side of the vacuum cleaner and wherein the wheels are mounted on the sides of the body and the cleaner head extends beyond the wheels on the side.

2. A vacuum cleaner as claimed in claim 1, wherein the body is substantially circular in plan view.

3. A vacuum cleaner as claimed in claim 2, wherein the wheels are located on a diameter of the body and the cleaner head is mounted parallel to the diameter.

4. A vacuum cleaner as claimed in claim 1, wherein the cleaner head comprises a brush housing and at least one elongate arm extending substantially horizontally between the brush housing and a mounting point on the body.

5. A vacuum cleaner as claimed in claim 4, wherein the mounting point is located on a front portion of the body and the brush housing is located beneath a rear portion of the vacuum cleaner.

6. A vacuum cleaner as claimed in claim 4 or 5, wherein the cleaner head comprises two elongate arms each extending substantially horizontally between the brush housing and a mounting point on the body.

7. A vacuum cleaner as claimed in claim 6, wherein the elongate arms are substantially parallel.

8. The vacuum cleaner as claimed in claim 7, wherein the elongate arm is pivotably connected to the brush housing and is also pivotably connected to the body to allow the brush housing to move transversely.

9. A vacuum cleaner as claimed in claim 4, wherein the elongate arm is pivotably connected to the brush housing and is also pivotably connected to the body to allow the brush housing to move transversely.

10. A vacuum cleaner as claimed in claim 1, wherein the cleaner head is mounted on the body so as to allow free relative rotation between the cleaner head and the body about a generally horizontal, transverse axis.

11. A vacuum cleaner as claimed in claim 1, wherein the cleaner head is movable to eliminate the protrusion of the cleaner head beyond the body.

12. The vacuum cleaner as claimed in claim 1, wherein one end of the cleaner head protrudes from one side of the body and another end of the cleaner head is within the body.

13. An autonomous vacuum cleaner, comprising a body having supporting wheels, drive means for driving the wheels so as to propel the vacuum cleaner in a direction across a surface to be cleaned, dust and dirt separating apparatus, a fan for drawing air into the dust and dirt separating apparatus and a cleaner head mounted beneath the body, transversely to said direction, and incorporating a dirty air inlet facing the surface to be cleaned, wherein the cleaner head protrudes transversely beyond the body on a side of the vacuum cleaner, and wherein the cleaner head is movable to reduce the protrusion of the cleaner head bond the side of the body.

14. A vacuum cleaner as claimed in claim 13, wherein biasing means are provided for returning the cleaner head to a protruding position after being moved transversely out of such a position.

15. A vacuum cleaner as claimed in claim 14, wherein the biasing means comprises a cushioning member located at an underside portion of the body.

16. A vacuum cleaner as claimed in claim 13, wherein the body is substantially circular in plan view.

17. A vacuum cleaner as claimed in claim 13, wherein the wheels are located on a diameter of the body and the cleaner head is mounted parallel to the diameter.

18. A vacuum cleaner as claimed in claim 13, wherein the cleaner head comprises a brush housing and at least one elongate arm extending substantially horizontally between the brush housing and a mounting point on the body.

19. A vacuum cleaner as claimed in claim 17 or 18, wherein the cleaner head comprises two elongate arms each extending substantially horizontally between the brush housing and a mounting point on the body.

20. A vacuum cleaner as claimed in claim 18, wherein the mounting point is located on a front portion of the body and the brush housing is located beneath a rear portion of the vacuum cleaner.

21. A vacuum cleaner as claimed in claim 19, wherein the elongate arms are substantially parallel.

22. A vacuum cleaner as claimed in claim 13, further comprising an elongate arm that is pivotably connected to a brush housing and is also pivotably connected to the body to allow the brush housing to move transversely.

* * * * *

UNITED STATES PATENT AND TRADEMARK OFFICE

CERTIFICATE OF CORRECTION

PATENT NO. : 6,601,265 B1
DATED : August 5, 2003
INVENTOR(S) : Geoffrey Michael Burlington It is certified that error appears in the above-identified patent and that said Letters Patent is hereby corrected as shown below:

Column 7,
Line 24, change "bond" to -- beyond --.

Signed and Sealed this

Eleventh Day of November, 2003

JAMES E. ROGAN
*Director of the United States Patent and Trademark Office*